United States Patent [19]

Ikeda et al.

[11] Patent Number: 4,749,829

[45] Date of Patent: Jun. 7, 1988

[54] CIRCUIT BREAKER

[75] Inventors: Tatsunori Ikeda; Shinji Yamagata; Fumiyuki Hisatsune, all of Fukuyama, Japan

[73] Assignee: Mitsubishi Denki Kabushiki Kaisha, Tokyo, Japan

[21] Appl. No.: 35,660

[22] Filed: Mar. 26, 1987

[30] Foreign Application Priority Data

Mar. 28, 1986 [JP] Japan ..... 61-71644

[51] Int. Cl.[4] ..... H01H 33/16

[52] U.S. Cl. ..... 200/144 AP

[58] Field of Search ..... 200/144 AP

[56] References Cited

U.S. PATENT DOCUMENTS

| | | | |
|---|---|---|---|
| 1,856,407 | 5/1932 | Apple | 200/144 AP |
| 2,956,255 | 10/1960 | Maartmann-Moe | 200/144 AP |
| 3,258,635 | 6/1966 | Carothers et al. | 200/144 AP |
| 3,310,768 | 3/1967 | Opalenik et al. | 200/144 AP |

FOREIGN PATENT DOCUMENTS

| | | | |
|---|---|---|---|
| 1939555 | 2/1970 | Fed. Rep. of Germany | 200/144 AP |
| 57-14954 | 6/1982 | Japan . | |

*Primary Examiner*—Robert S. Macon

*Attorney, Agent, or Firm*—Lowe, Price Leblanc, Becker & Shur

[57] ABSTRACT

A circuit breaker has current-limiting resistances (12) which are provided between a base (1) and a cover (18) and which limit a current to a tripping bimetal (11) for preventing fusing of the tripping bimetal (11).

6 Claims, 3 Drawing Sheets

CIRCUIT BREAKER

FIELD OF THE INVENTION AND RELATED ART STATEMENTS

1. Field of the Invention

The present invention relates generally to an improvement in a circuit breaker, and more particularly to a circuit breaker having superior breaking characteristic and small-sized case.

2. Description of the Related Art

A typical conventional circuit breaker has a structure and operation as described hereafter with reference to FIG. 1. The circuit breaker has a movable arm 5 and a stationary arm 6 having repulsion mechanism. The grid plates 15*a* are provided in an arc-extinguishing chamber 15 for extinguishing arc which occurs in opening of a contact 5*a* and a contact 6*a*. A current-limiting resistance 12 provided between a terminal 14 and the stationary arm 6 limits a current to a tripping bimetal 11 for preventing fusing of the tripping bimetal 11. The current-limiting resistance 12 is located at the neighboring side position of the arc-extinguishing chamber 15. An insulating barrier 16 is provided between the arc-extinguishing chamber 15 and the current-limiting resistance 12.

A handle 4 moves the movable arm 5 through a link-mechanism 20. When an overflow current occurs, the bimetal 11 bends and pushes a trip bar 10. When larger overcurrent flow occurs, a plunger 9*a* driven by an electromagnet 9 pushes the trip bar 10, and the trip bar 10 performs tripping.

Above-mentioned mechanisms are fixed to a base 1, and a cover 18 is provided at the back side of the base 1. The movable contact 5, the stationary contact 6, the arc-extinguishing chamber 15 and the current-limiting resistance 12 are provided for each phase, and, 3 sets of these are provided in case of three-phase circuit breaker.

In the circuit breaker, because the current-limiting resistance 12 is located at the neighboring side position of the arc-extinguishing chamber 15, the plane view area of each circuit breaker increases. In other words, plane view area of the arc-extinguishing chamber 15 has to be decreased by providing the current-limiting resistance 12 at the neighboring side position. The decrease of volume of the arc-extinguishing chamber 15 causes lowering of breaking characteristic of the circuit breaker. Further, because the insulation barrier 16 must be provided between the arc-extinguishing chamber 15 and the current-limiting resistance 12, the cost becomes expensive.

OBJECT AND SUMMARY OF THE INVENTION

It is an object of the invention to provide an improved circuit breaker having superior breaking characteristic and small-sized case.

A circuit breaker in accordance with the present invention comprises:

a stationary contact, a movable contact, a base which holds the stationary contact and the movable contact, a cover which covers bottom part of the base, and a current-limiting resistor provided between the base and the cover.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENTS

Figure 1:
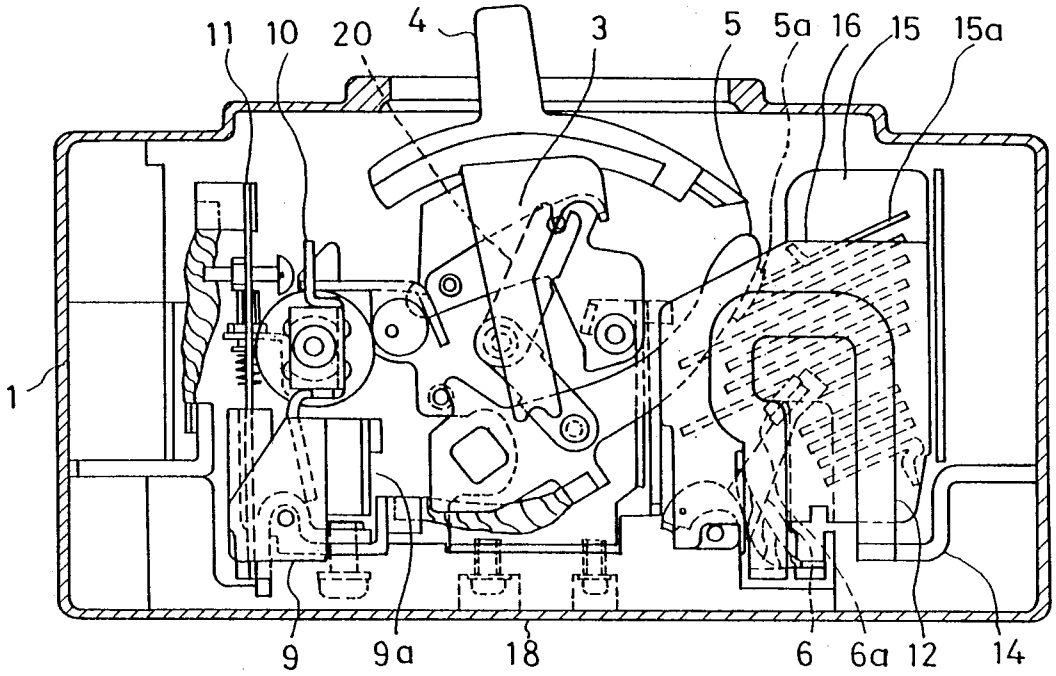
FIG.1 (Prior Art)
FIG. 1 is the cross-sectional side view of the conventional circuit breaker.
Figure 2:
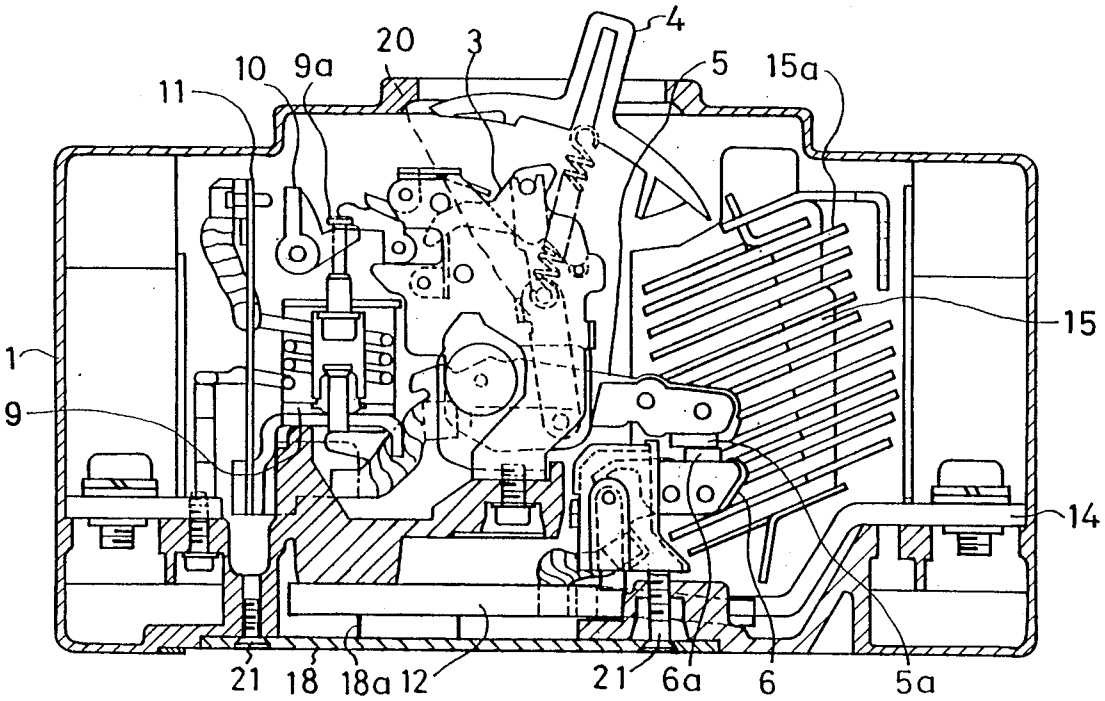
FIG. 2 is a cross-sectional side view of a circuit breaker embodying the present invention.
Figure 3:
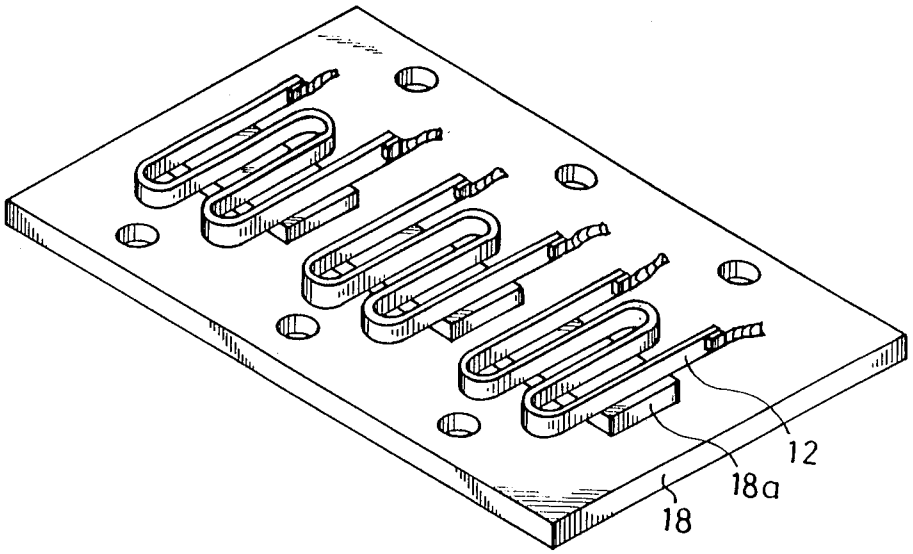
FIG. 3 is a perspective view of a cover 18 and a current-limiting resistances 12 used in the circuit breaker of FIG. 2.

The structure of a preferred embodiment of a circuit breaker embodying the present invention is described in detail with reference to FIGS. 2 to 3. As shown in FIG. 2, the circuit breaker has a movable arm 5, and a stationary arm 6 having repulsion mechanism. The grid plates 15*a* are provided in an arc-extinguishing chamber 15 for extinguishing arc which occurs in opening a contact 5*a* and a contact 6*a*.

A handle 4 is provided to move the movable arm 5 through a link-mechanism 20. When an overcurrent flows, the bimetal 11 bends and pushes a trip bar 10. When a larger overcurrent flows, a plunger 9*a* driven by a electromagnet 9 pushes the trip bar 10, which therefore performs tripping.

Above mentioned mechanisms are fixed to a base 1 of an insulating material. At the back side of the base 1, a cover 18 of an insulating material is provided. As shown in FIG. 3, the cover 18 has protrusions 18*a* as abutting means on which current-limiting resistances 12 of M-shape are fixed. The current-limiting resistance 12 is connected between a terminal 14 and the stationary arm 6 and limits a current to a tripping bimetal 11 for preventing fusing of the tripping bimetal 11. As shown in FIG. 2, the cover 18 is fixed to the base 1 by screws 21 and thus the current-limiting resistances 12 are fixed pinched between the protrusions 18*a* and the bottom of the base 1. Because the current-limiting resistances 12 are provided under the base 1, the arc-extinguishing chamber 15 becomes to have a wide space. Therefore, the breaking characteristic is improved.

Generated heat in the current-limiting resistance 12 is radiated or removed by conduction through the cover 18. For such heat dissipation through the cover 18, use of a good heat conduction such as metal may be used. Therefore, good heat radiation is carried out.

Although in the above-mentioned embodiment of the invention the protrusion 18*a* is provided for each current-limiting resistance 12, in other modified embodiments of the invention plural protrusions 18*a* may be provided for each current limiting resistance 12.

As has been described in detail for various embodiments, the circuit breaker in accordance with the present invention has superior current breaking characteristic and superior heat radiation characteristic.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A circuit breaker comprising:

a stationary contact, a movable contact, a base which holds the stationary contact and the movable contact, a cover which covers a bottom part of the base, and current-limiting resistor means provided between the base and the cover and disposed to extend substantially along said cover such that heat generated during passage of current through the resistor is readily conducted to said cover.

2. A circuit breaker in accordance with claim 1, wherein said cover has abutting means to hold the current-limiting resistor means.

3. A circuit breaker in accordance with claim 1, wherein said cover is made of a metal plate.

4. A circuit breaker in accordance with claim 1, wherein said abutting means are made of an insulation material of good heat conductivity.

5. The circuit breaker of claim 2, wherein said current-limiting resistor means is in the form of strip-shaped resistor elements curved into an M-shape and further including protrusions on the cover against which the M-shaped resistor elements are fixed.

6. The circuit breaker of claim 5, wherein there are a plurality of said M-shaped resistors extending substantially coplanar with each other along the cover.

* * * * *